US005101712A

United States Patent [19]

Dean, Jr.

[11] Patent Number: 5,101,712

[45] Date of Patent: Apr. 7, 1992

[54] SUB-SLAB DEPRESSURIZATION RADON REDUCTION METHOD AND APPARATUS

[75] Inventor: Wayne P. Dean, Jr., Orlando, Fla.

[73] Assignee: Mary I. Dean, Wildwood, Fla.

[21] Appl. No.: 602,706

[22] Filed: Oct. 24, 1990

[51] Int. Cl.[5] ..... F24F 11/00

[52] U.S. Cl. ..... 454/341; 52/169.5; 454/345; 454/909

[58] Field of Search ..... 98/42.02, 42.06; 52/169.5; 405/43, 128, 229, 258

[56] References Cited

U.S. PATENT DOCUMENTS

| | | | |
|---|---|---|---|
| 4,858,521 | 8/1989 | Heh | 98/42.05 |
| 4,957,394 | 9/1990 | Jarnagin et al. | 405/128 |
| 4,988,237 | 1/1991 | Crawstaw | 405/229 |

OTHER PUBLICATIONS

Michael Lafavore, *Radon: the Invisible Threat,* 1987, pp. 134–191.

*Application of Radon Reduction Methods,* EPA/625-/S-88/024, U.S. Environmental Protection Agency, Aug. 1988.

*Randon Reduction Methods: A Homeowner's Guide,* OPA-86-005, U.S. Environmental Protection Agency, Aug. 1986, pp. 16, 18 and 20.

*Radon-Resistant Residential New Construction,* EPA/600/8-88/087, U.S. Environmental Protection Agency, Jul. 1988, pp. 29–51.

*Radon Reduction Techniques in Schools: Interim Technical Guidance,* EPA 520/1-89-020, U.S. Environmental Protection Agency, Oct. 1989, pp. 15–21.

*Radon Reduction in New Construction: An Interim Guide,* OPA-82-009, U.S. Environmental Protection Agency, Aug. 1987.

*Primary Examiner*—Harold Joyce

*Attorney, Agent, or Firm*—Warren L. Franz

[57] ABSTRACT

A sub-slab depressurization (SSD) radon reduction system uses an existing sub-slab refrigerant line chase as a vent pipe for suction of soil gas from a centrally located sub-slab suction point. A suction pit is excavated proximate the penetration of the slab by the chase, preferably by drilling and removing soil through the chase. The open ends of the chase are sealed with segmented end caps having two tubular sections, one for sealing around the refrigerant lines and the other for connecting externally to a soil gas evacuating air pump and internally to system monitoring instrumentation. A condensate dump assembly is located at the chase exit port.

20 Claims, 2 Drawing Sheets

SUB-SLAB DEPRESSURIZATION RADON REDUCTION METHOD AND APPARATUS

This invention relates to a method and apparatus for reduction of radon levels in buildings by sub-slab depressurization utilizing existing building conduits to impart sub-slab negative pressure.

BACKGROUND OF THE INVENTION

Radon is a radioactive gas that occurs naturally in soil gas present underground. Soil gas can flow into a building through openings where the floor and walls contact the soil. Prolonged human exposure to elevated concentrations of radon and radon decay products has been recognized as a health hazard. Radon is particularly a problem in slab-on-grade and basement-construction housing where a thermal stack effect, air exhausting appliances, or similar factors cause a pressure gradient across the slab so that air pressure indoors is less than air pressure in the surrounding soil. This results in a phenomenon known as depressurization wherein radon is drawn from the soil through cracks and openings into the building.

The amount of radon that enters the building structure is a function of how much radon gas or radon parent compounds are present in the sub-slab soil, the permeability of the soil, the cracks and openings between the soil and the building interior, and the forces that drive the radon-containing gas along the pathways into the structure. Radon level mitigation techniques include blocking entry using barrier methods, reducing radon entry driving forces, and diverting radon from entering using sub-slab ventilation and depressurization.

Sub-slab depressurization (SSD) is perhaps the most successful and widely used technique to date for reducing radon concentration in slab-on-grade and basement houses with sub-slab communication. Installation of an SSD system involves the insertion of vent pipes through penetrations in the slab to access suction points in the aggregate or permeable soil beneath. Fans or air pumps are used to suck the radon-containing soil gas from under the slab through the pipes, releasing it outdoors. This sub-slab suction method works by creating a negative (relative to building interior) pressure field under the slab which prevents the gas from entering the building. A primary sub-slab suction point is normally located centrally of the area to be mitigated, though additional suction point locations may be necessary if sub-slab air flow communication (i.e., pressure field extension) is insufficient.

In a typical method of remedial radon reduction using an SSD approach, a hole is drilled through the slab and into the underlying soil at the chosen suction point location and an open or aggregate filled suction pit is established below the slab in communication with the hole penetration. The layouts of utility pipes and sub-slab conduits are noted beforehand to avoid drilling through them. A vent pipe is then inserted through the slab into the pit to establish a vertical drop or riser of suction pipe from the pit to a point, such as in the attic, located outside the conditioned space of the building. An exhaust fan is then connected to the upper end of the pipe to provide suction for drawing the gas up the stack and exhausting the same externally of the building. The run of riser pipe is continuously extended from the sub-slab pit location to the attic, with bends and elbows selected to minimize pressure drops in the piping. The vent pipe fan and all pressurized portions of the pipe located outside the conditioned space are sloped to drain condensation back to the sub-slab soil and prevent accumulation of water in the pipe or fan housing. The annular region between the vent pipe and the slab penetration hole is provided with an airtight seal.

Where sub-slab permeability is inadequate to allow the required pressure field extension, additional sub-slab suction points may be located and vent pipe upper ends joined by an attic manifold for connection to a common exhaust fan. The fan is located for release of exhausted air outside the building, preferably above the roof—away from operable roof openings, air intakes or open windows. Coverage may be increased if a larger capacity fan and/or greater diameter vent pipe is used. The SSD system is normally used in conjunction with steps taken to seal entry points such as cracks, joints, utility openings, etc.

A certain amount of sealing is recommended for sub-slab suction mechanisms to work effectively. Conventional construction often situates HVAC (heating, air-conditioning and ventilation) units at central locations and connects refrigerant lines from such units to the outside through open-ended hollow ductwork, chases or similar conduits (hereafter "chases") which traverse a path from an interior point above the slab, through the slab, and then along a sub-slab path generally horizontally to an external exit point. Similar chases may be utilized to carry electrical wiring, telephone or other utility conduits. To avoid radon entry through such chases, the conventional approach to radon remediation recommends either that the ends be fully sealed to close the gap between the chase inside diameter and the outside diameters of the conduits located therein or preferably, if feasible, that any sub-slab ductwork be sealed off completely and replaced with new above-slab ductwork. For new construction, above-slab ductwork is suggested. In new construction, it is also recommended too that the slab supporting sub-soil have good gas communication and to consider preplacing stub-up pipes at the time of pouring of a monolithic slab to leave capped connections for use in subsequent attachment to vertical risers installed later, should a sub-slab ventilation system become advisable.

SUMMARY OF THE INVENTION

It is an object of the present invention to provide a sub-slab depressurization remedial radon reduction method wherein an existing sub-slab utility chase is used as a vent pipe for suction of soil gas from a sub-slab suction point to a remote exhaust point. A further object of the present invention is to provide apparatus useful in sealing the ends of a utility chase as an aid to practicing the inventive method, and of apparatus usable therewith for disposing of chase suction condensation.

In accordance with the invention, the soil gas pressure below a building structure is reduced by establishing a suction point in proximity to the penetration of an existing sub-slab refrigerant line chase or the like and placing the same in communication with the chase. The chase is then sealed except for passage of the refrigerant lines or other internal conduits and an air pump is connected outside the structure at the exit port of the chase to exhaust soil gas, including radon, from the suction point to the outside of the structure through the sealed chase line. In a preferred embodiment of the method of the invention, a suction pit is excavated by drilling through a vertical section of the chase at the point of penetration through the slab. In accordance with the apparatus of the invention, a multi-apertured end cap is placed in sealing engagement with each end of the chase, and a condensate dump assembly is located between the chase exit port and the pump.

DETAILED DESCRIPTION OF THE DRAWINGS

Figure 1A:
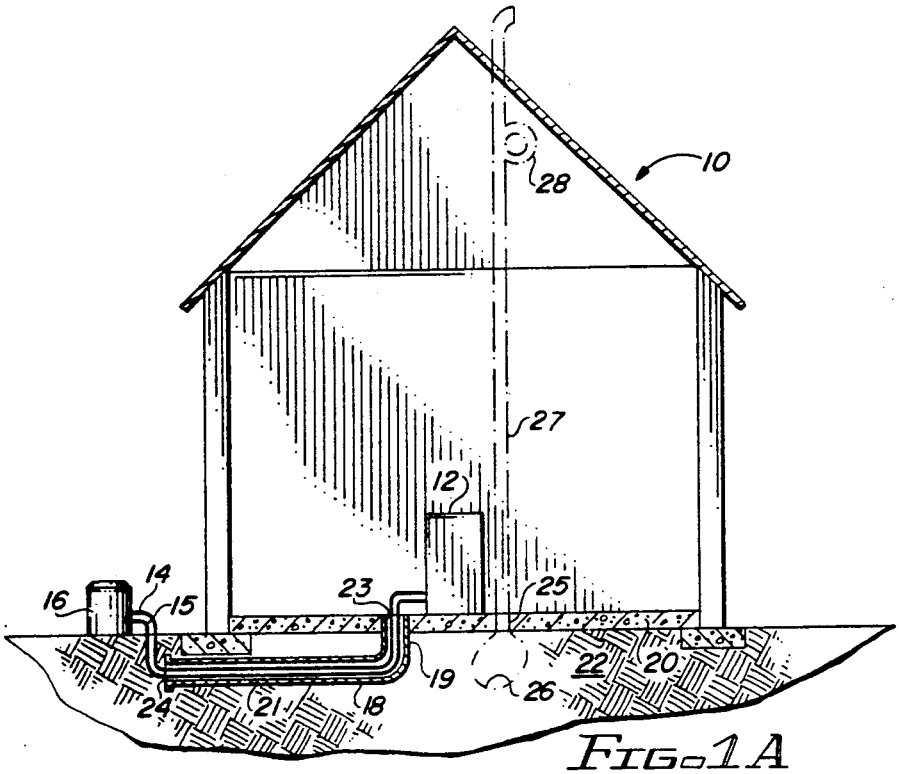
Figure 1B:
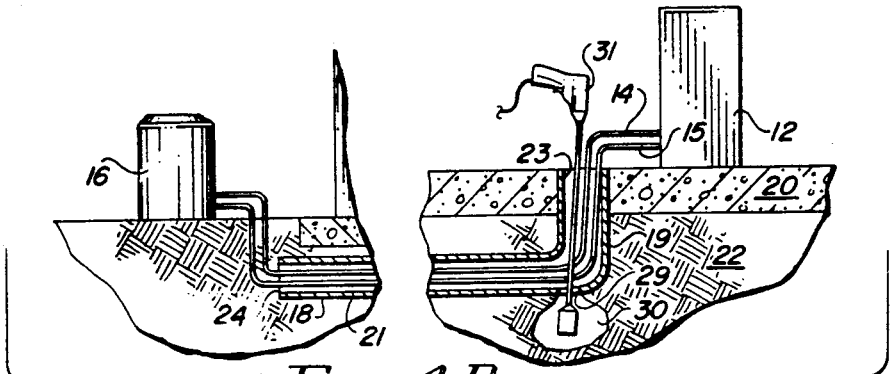
Figure 1C:
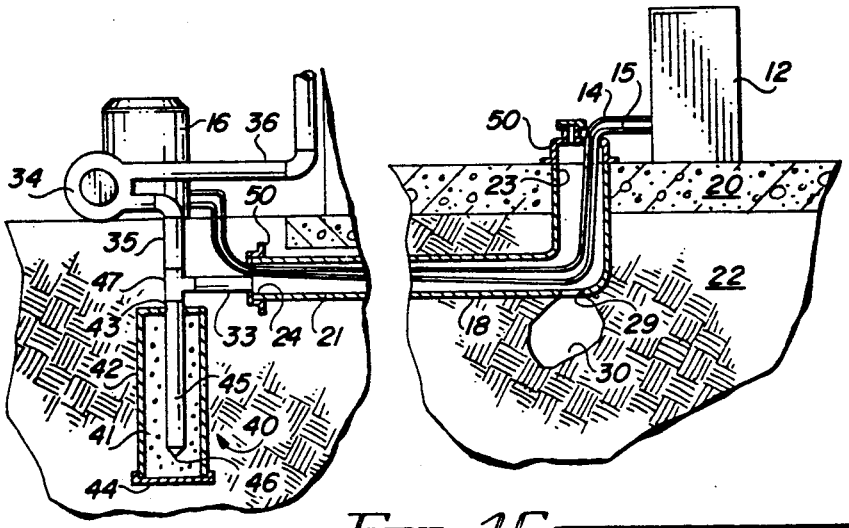
Figure 1D:
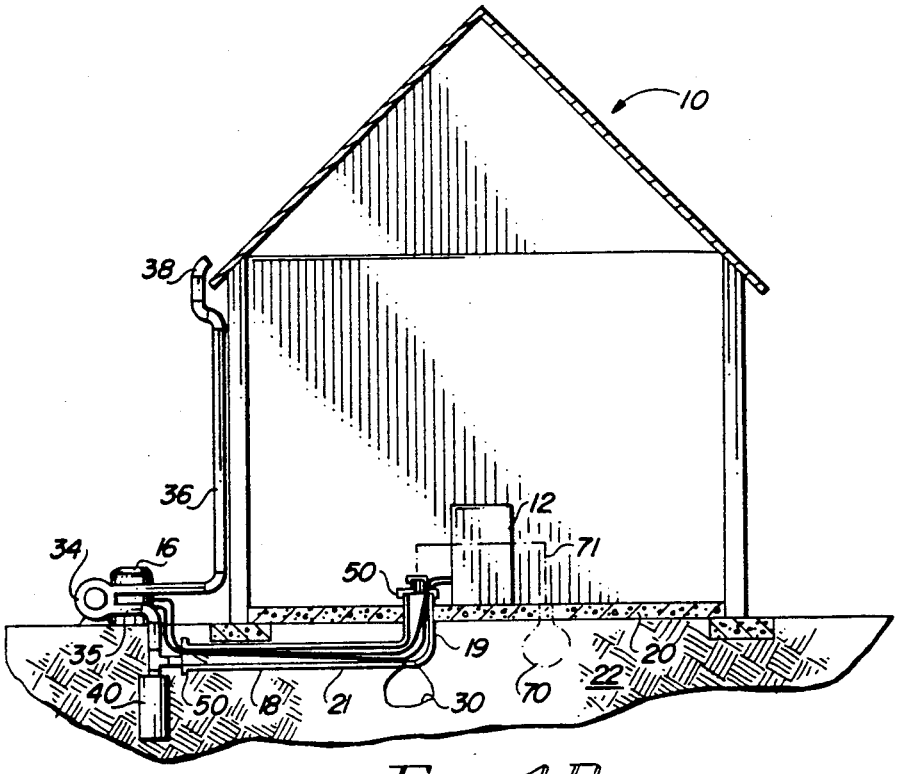
Figure 2:
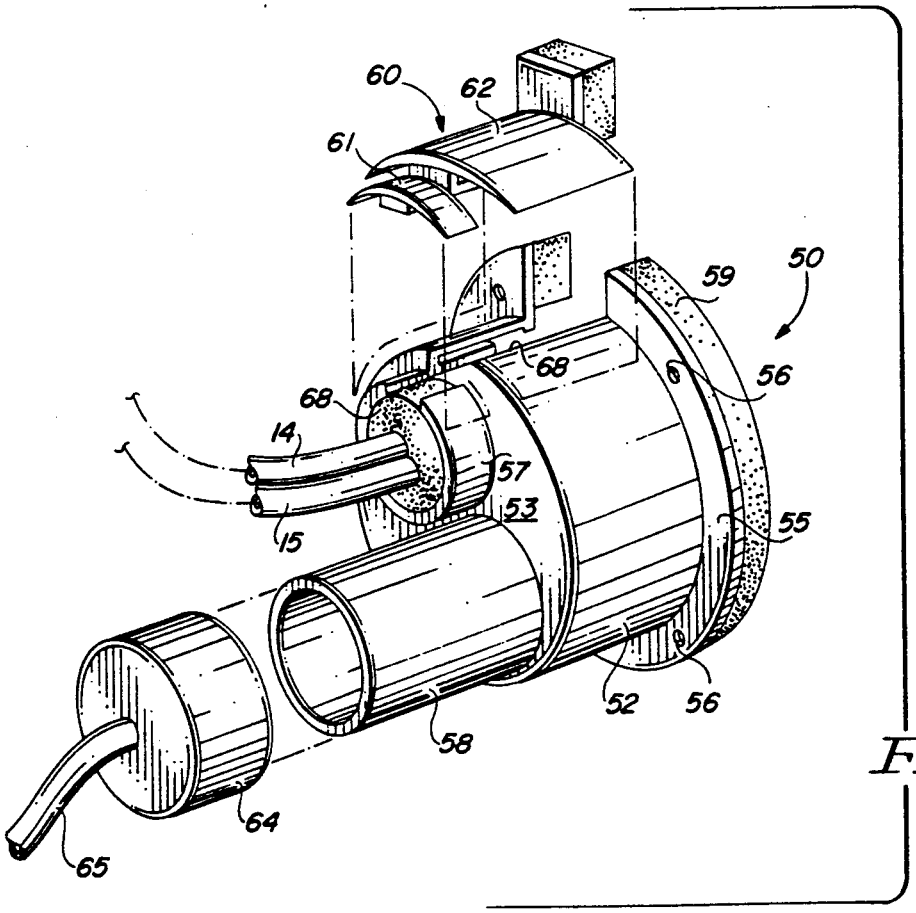

Embodiments of the invention have been chosen for purposes of illustration and description, and are shown in the accompanying drawings, wherein:

FIGS. 1A-1D are schematic views showing successive steps in an SSD remedial radon reduction method in accordance with the invention; and FIG. 2 is a perspective view of an embodiment of end cap in accordance with the invention which can be used in the method of FIGS. 1A-1D.

Throughout the drawings, like elements are referred to by like numerals.

DETAILED DESCRIPTION OF PREFERRED EMBODIMENT

The principles of the invention are described by way of example in their application to the reduction of radon levels in the interior of a building structure 10 having a centrally located heating, air-conditioning and ventilation (HVAC) unit 12 having refrigerant passage and return lines 14, 15 connected to an externally located heat exchanger (viz. compressor) 16 through a sub-slab path provided by an open-ended, hollow conduit chase 18. The chase 18 has a generally vertical run portion 19 that penetrates a slab 20 of the building 10 proximate the HVAC unit 12. The top of portion 19 includes an intake port terminal end 23 internally within structure 10. Portion 19 is joined below the slab 20 by a generally horizontally extending sub-slab run portion 21 that traverses the soil 22 underlying the slab 20 and connects to an exit port terminal end 23 externally of the structure 10. The chase 18 is closed except at intake and exit ends 23, 24 and has an inside diameter chosen large enough and bend angles chosen small enough to accommodate the snaking of the lines 14, 15 from the HVAC unit 12 through the portions 19, 21 to the exchanger 16.

For comparison purposes, a typical prior art sub-slab depressurization (SSD) approach to reduce sub-slab soil gas pressure and provide venting to a remote gas discharge point is shown by the dashed line rendition in FIG. 1A. Following the conventional SSD approach, a hole 25 would be drilled to penetrate through the slab 22 above a selected centrally located suction point. A suction pit 26 would be excavated at that point, and a vertical riser pipe 27 installed to convey gas to an attic location, for external discharge under action of a suction fan 28. The space between the outside diameters of lines 14, 15 and the internal diameter of chase 18 would be sealed at the chase ends 23, 24 as part of the collateral process of closing entry points; and care would be taken not to drill through the chase 18 or in any other way open communication between the interior of chase 18 and the subslab soil 22. Such conventional approach would, thus, necessitate a new penetration of slab 20 and the routing of radioactive gas carrying vent pipe through the conditioned living space of building structure 10.

In contrast, the method of the invention makes use of the existing penetration and sub-slab path of the already present chase 18 to provide the penetration and venting path for the sub-slab depressurization.

As shown in FIG. 1B, following an embodiment of the method of the invention, a sub-slab soil location proximate the base of the vertical run 19 of the existing chase 18 is chosen as a suction point for development of the SSD system. Known drilling techniques are used to drill through the wall of the chase 18 and into the soil 22 at the base of the chase portion 19, as shown in FIG. 1B. The chase 18 used for running refrigerant lines 14, 15 for a typical existing slab-on-grade or basement construction of building structure 10 will be sufficiently large for insertion of drilling tools through the proximal end 23 of the chase 18. In the usual case, the encountered run 19 will penetrate the slab 22 vertically. If an elbow exists between the internal end 23 and the vertical run 19, an opening can be formed at the upper end of the run 19 for drilling and then subsequently reclosed.

Once the bottom of the run 19 has been opened at a hole 29 to the underlying soil 22, a suction pit 30 can be excavated to serve as a focus for the sub-slab negative pressure field extension. The pit 30 may, for example, be an open hole approximately 12"-18" deep and 18"-24" in diameter, or may be of somewhat larger dimensions and filled with aggregate. One way to drill the pit 30 is by means of a rotary hammer drill 31, using a wet/dry vacuum hose to remove the loosened soil.

As shown in FIG. 1C, once the drilling and excavation is completed, the proximal and distal ends 23, 24 of the chase 18 are sealed off. The end 23 is sealed by closing the annular gap between the outside diameters of the lines 14, 15 and the inside diameter of the chase 18. The end 24 is likewise sealed, except that a soil gas venting exhaust port 33 is left open. The intake of gas suction pump 34 is then placed in communication with the port 33 by means of an intermediate length of vent pipe 35, and another length of vent pipe 36 is connected to the pump exhaust and run to a roof location 38 (FIG. 1D) for the safe discharge of gas relative to the structure 10.

A suitable pump 34 may be an electrically powered ring compressor, regenerative or vortex blower, rated for continuous operation and having a thermal overload with automatic reset features. Good adhesive airtight seals, such as urethane or polysulfide sealant, are provided between piping 35, 36 and inlet and outlet connections of the pump housing in accordance with good SSD system installation practice. To achieve good subsoil air flow penetration, the pump should preferably be rated for not less than 10 cfm. @5" water column pressure.

Condensation is less of a problem with the SSD system of the invention than with that of the prior art. Unlike the riser pipe 27 (FIG. 1A) of the conventional approach, the active gas-conveying portion of the sealed chase 18 is located below the slab 22 and away from conditioned living space. Nevertheless, arrangements should be made to minimize the accumulation of any condensate in the sealed chase 18. The hole 29 is located proximate the lowest elevation of the vertical portion 19 and pit 30 is made deep enough to ensure that its bottom will be below the lowest point of the horizontal run 21. Condensation in the portion 19 is thus encouraged to flow into the pit 30 and any liquid will be kept from entering the chase 18 from the pit 30. Normally, the horizontal portion 21 will be sloped downwardly toward the exit port 24. Condensate forming in the chase 18 that does not enter the pit 30 will, thus, be flowed out toward the distal end 24. Condensate can be moved from local dips along the length 18 by choice of a suitable suction force for the pump 34.

To dispose of the condensation, if any, that exits at the port 24 and to keep it away from the pump system 34 and vent pipe 36, a condensate disposal assembly 40 (FIGS. 1C and 1D) can be connected between the chase 18 and the pump 34. The assembly 40 may suitably be in the form of an approximately 24" vertical length of perforated PVC pipe 41, covered with a sleeve 42 of nonwoven fabric to keep the soil from entering the interior of pipe 41 through the pipe perforations. Upper and lower end caps 43, 44 fit over the ends of the pipe 41 and the ends of sleeve 42. A condensate collection and dump tube 45 of outside diameter less than the inside diameter of pipe 41, open at the top and having a duck bill valve 46 at the bottom, depends internally within pipe 41 from a central opening of end cap 43 down to a point approximately 6" above the end cap 44. Installation of the assembly 40 can be readily accomplished using a posthole digger to form the hole for the pipe 41 and using a T-fitting 47 to connect the central opening in end cap 43 to the pipe 35 below the gas venting port 33 of chase 18. The assembly 40 functions in the manner of a French drain at the lowermost point of chase 18, external to the structure 10. The exhaust port 33 should be located at the lowermost part of the chase 18 exit. The distance from port 33 to valve 46 and the parameters for dumping the valve 46 should be chosen so that the condensate can be dumped before it reaches the pump, without adversely affecting the draw of gas from the pit 30.

An embodiment of end cap 50, utilizable for sealing the chase ends 23, 24 of chase 18 is shown in FIG. 2. The depicted end cap 50 may, for example, be dimensioned, configured and adapted to seal the end of a chase 18 in the form of a 4" PVC pipe. It will, of course, be appreciated that the form of the cap 50 may be changed to accommodate different structures of the chase 18.

As illustrated, the cap 50 comprises a main tubular section 52, having a closed outer end 53 and an open inner end 54. The end 54 is circumferentially surrounded by a planar toroidal flange 55 having a plurality of preformed apertures 56 located at angularly-spaced positions thereon to provide means for attachment of the cap 50 by the flange 55 to an abutting surface such as the top surface of slab 22 surrounding the opening 23. To improve the seal with the abutting surface, the flange 55 is backed by a closed cell, neoprene gasket 59. The interior of the section 52 is dimensioned to fit over a projection, if any, of the vertical portion 19 above the slab 22 and also over the end 24 of the horizontal portion 21. The end 53 of the cap 50 has two apertures to which are fixed smaller diameter tubular sections 57, 58, respectively, each aligned axially-parallel with the tubular section 52. The section 57 is open-ended and sized to accommodate passage therethrough in adjacent positions of the refrigerant lines 14, 15. It is located adjacent the top of the end 53 and includes portions extending both inwardly and outwardly thereof. The section 58 is open-ended and joins the bottom of the end 53 so that the lowermost part of its inside diameter is in line with the lowermost part of the inside diameter of the main tubular section 52 (i.e., it is internally cotangent with the main section 52 at the location of the closed outer end 53). The outside diameter of section 58 is sized to mate with the auxiliary piping 35 (or T-fitting 45) that connects to the suction pump 34. The inside diameter of section 58 is dimensioned to achieve the desired soil gas suction flow rate in conjunction with the chosen pump 34.

In accordance with a preferred embodiment of the invention, the cap 50 is segmented to provide an upper portion 60 which may be removed, as shown in FIG. 2, to permit the cap 50 and section 57 to be brought over the lines 14, 15 without the necessity to disconnect those lines from the HVAC 12 or heat exchanger 16. In addition to removed minor portions of the section 57, main body section 52, flange 55 and gasket 59, the removable portion 60 has two arcuate saddle pieces 61, 62 which conform to the outside diameters of the section 57 and section 52, respectively. The pieces 61, 62 assist in resecuring the portion 60 onto the main body of the cap 50 after insertion of the lines 14, 15 and provide platforms around which hose clamps (not shown) can be passed, if desired. A plug in the form of a closed end cap 64, which may have a central flexible tube 65, is provided to serve as a closure to fit over the opening of the section 58. Closed cell, neoprene disks 68 are fitted within the inner and outer openings of the section 57 to aid in sealing the annular region around lines 14, 15.

In use, the removable upper portion 60 is separated from the main body of a cap 50 and the main body is positioned over the open interior end 23 of the chase 18 (see FIG. 1C), with the flange 55 and gasket 59 abutting the slab 22. The refrigerant lines 14, 15 are pulled to one side of the chase 18 opening so that they can be passed through the main body part of the section 57. The neoprene disks 68 are slit to pass the lines 14, 15. The slots 56 are used to secure the flange to the slab 22. The portion 60 is mated by means of urethane, polysulfide or other suitable adhesive sealant establishing an airtight seal (and, if desired, hose clamps), to reunite the portion 60 to the rest of the cap 50. The same sealant is applied to seal the gaps between the internal conduits 14, 15, the disks and the walls of the section 57. Sealant is likewise applied, as appropriate, to fix the end 23 of the chase portion 19 in airtight fashion within the cavity of the tubular section 52 and/or to complete the seal of the flange 55 and gasket 59 to the slab 22. The plug 64 is attached over the opening of section 58.

An identical second cap 50 is mounted in similar fashion at the distal end 24 of the chase 18. The second cap 50 is positioned so that the tubular section 58 is mated proximate the lowest part of the run 21, as an aid in discharging condensation, as mentioned above. For the cap 50 attached to the end 24, in contrast to the cap 50 attached at the end 23, the plug 64 is left off to provide the exhaust port 31 opening through which soil gas can be drawn. Piping 35 (or the T-fitting 47) is then attached in airtight sealing engagement at the outer end of section 58 to communicate the now sealed, hollow channel interior of the chase 18 for soil gas evacuation purposes with the upstream side of the pump 34. As with the first cap 50, where appropriate, the flange 55 and gasket 59 is attached to adjacent structure and/or the portion 21 at the end 24 of chase 18 is fitted and sealed within the tubular section 52.

The plugged opening of section 58 of the cap 50 used at the end 23 within the structure 10 can, if desired, be used as an observation port to monitor the SSD radon remediation process. For example, a fiber optic tool can be periodically inserted at this point to determine any deterioration in the status of the chase 18 and pit 30. Moreover, a pressure gauge can be attached to the end of the optional hose 65 to monitor the pressure in the chase 18 and alarm circuitry can be installed to provide a signal whenever the measured pressure gradient between the sealed chase and the interior of structure 10 deviates from a preestablished gradient by more than a predetermined amount. A similar observation port (not shown) can be provided on the end cap 43 of the condensate disposal assembly 40, if desired, for use in viewing and cleaning the interior of pipe 41.

Should the configuration of chase 18 make it expedient to establish the main suction port 30 by drilling through the slab 20 rather than the chase 18, or should it become advisable to establish additional sub-slab suction points 70 (FIG. 1D) at the same or at a later time, the plug 64 of section 58 can be left off the first cap 50 and the unclosed section 58 used to connect piping 71 to communicate the main suction point 30 and/or the additional suction points 70 with the interior of chase 18 for exhausting gas through the chase 18.

Those skilled in the art to which the invention relates will appreciate that other substitutions and modifications can be made to the described embodiment without departing from the spirit and scope of the invention as described by the claims below.

I claim:

1. A sub-slab depressurization (SSD) method for reducing radon gas levels in a structure having a slab and an existing utility line chase penetrating the slab and running underneath the slab, the chase having an intake port internal to the structure and an exit port external to the structure, and the method comprising:

establishing a suction point in the soil underneath the slab and proximate the penetration of the slab by the chase;

communicating the suction point with the interior of the chase;

sealing the chase, except for passage therethrough of utility lines and establishing an opening external to the structure to serve as a gas venting port;

connecting gas exhausting means between the gas venting port and a gas discharge location external to the structure; and exhausting gas from the sub-slab suction point to the external gas discharge location through the sealed chase using the gas exhausting means.

2. A method as in claim 1, wherein the suction point is established by drilling through the chase and excavating a suction pit by removing some of the sub-slab soil through the chase.

3. A method as in claim 1, wherein the chase is sealed and the gas venting port is established by sealing the intake and exit ports of the chase with multi-apertured end caps.

4. A method as in claim 3, wherein each end cap includes first and second apertures, the first aperture of each end cap is used to pass utility lines and the gas venting port is established by the second aperture of the end cap which is used to seal the exit port.

5. A method as in claim 4, further comprising connecting apparatus for monitoring the pressure in the sealed chase to the second aperture of the end cap which is used to seal the intake port.

6. A method as in claim 4, further comprising establishing a second suction point in the soil underneath the slab, and communicating the second suction point with the interior of the chase through the second aperture of the end cap which is used to seal the intake port.

7. A method as in claim 1 further comprising locating a condensate disposal assembly between the exit port and the gas exhausting means.

8. A sub-slab depressurization (SSD) method for reducing radon gas levels in a structure having a slab, an existing utility line chase having a vertically extending portion penetrating the slab and a horizontally extending portion joining the vertically extending portion and running underneath the slab; the chase having an intake port internal to the structure and an exit port external to the structure, and the method comprising:

establishing a suction pit in the soil underneath the slab proximate the vertically extending portion;

sealing the intake port, except for passage therethrough of utility lines;

sealing the exit port, except for passage therethrough of utility lines and establishing an opening external to the structure to serve as a gas venting port;

connecting a gas suction pump between the gas venting port and a gas discharge location external to the structure; and exhausting gas from the sub-slab suction pit to the external gas discharge location through the sealed port chase using the gas suction pump.

9. A method as in claim 8, wherein the suction pit is established by drilling through the base of the vertically extending portion.

10. A method as in claim 9, wherein the gas venting port is established at a lowest elevation of the exit port, and the method further comprises locating a condensate disposal assembly between the gas venting port and the gas suction pump.

11. A method as in claim 10, wherein the condensate disposal assembly comprises a vertical length of perforated pipe located below the elevation of the gas venting port, covered with a soil filtering sleeve and including a shorter, internally-located condensate collection and dump tube having an open upper end and valved lower end.

12. A method as in claim 9, wherein the gas suction pump comprises a ring compressor and has a rating of not less than 10 cfm. at 5" water column pressure.

13. A method as in claim 9 for reducing radon levels in a structure having a roof, and wherein the gas suction pump is connected between the gas venting port and a gas discharge location established adjacent the roof.

14. A method as in claim 9, wherein the intake and exit ports are sealed and the gas venting port is established by means of multi-apertured end caps.

15. A method as in claim 14, wherein each end cap includes first and second apertures, a removable portion and a main body portion, the removable portion partially defining the first aperture; and utility lines are passed through the first aperture by separating the removable portion from, and subsequently reuniting the removable portion to, the main body portion.

16. In combination with a sub-slab depressurization (SSD) system for reducing radon gas levels in a structure having a slab and a suction point established in soil underneath the slab; the system comprising a tubular conduit being in communication with the suction point and including a port, and the system further comprising gas exhausting means connected to the port for drawing gas from the suction point through the conduit and out the port; an end cap positioned in sealing engagement with the port, and the end cap comprising:

a main tubular section having inside and outside diameters, a closed outer end and an open inner end;

first and second tubular sections having inside and outside diameters smaller than the inside and outside diameters of the main tubular section; the first and second tubular sections being axially-parallel to the main tubular section and respectively defining first and second apertures in the main tubular section;

a planar toroidal flange circumferentially surrounding the inner end of the main tubular section; and the cap being segmented into a main body portion and a removable portion, the removable portion including part of the first tubular section defining the first aperture, part of the flange, and part of the main tubular section.

17. An end cap in combination as in claim 16, wherein the flange has a plurality of preformed apertures located at angularly-spaced positions around the flange.

18. An end cap in combination as in claim 16, wherein the end cap further comprises a closed cell gasket backing the flange; and wherein the removable portion further includes part of the gasket.

19. An end cap in combination as in claim 16, wherein the removable portion further comprises a first arcuate saddle piece having an inside diameter which conforms to the outside diameter of the first tubular section; and a second arcuate saddle piece, axially-spaced from the first arcuate saddle piece, and having an inside diameter which conforms to the outside diameter of the main tubular section.

20. An end cap in combination as in claim 19, wherein the conduit has an outside diameter; the inside diameter of the main tubular section matches the outside diameter of the conduit; the first tubular section includes parts extending both inwardly and outwardly of the outer end of the main tubular section; and the second tubular section is located with its inside diameter internally cotangent with the inside diameter of the main tubular section at the outer end of the main tubular section.

* * * * *